United States Patent [19]

Yost

[11] Patent Number: 4,741,317

[45] Date of Patent: May 3, 1988

[54] VAPOR RECOVERY SYSTEM WITH VARIABLE DELAY PURGE

[75] Inventor: John V. Yost, Trenton, Mich.

[73] Assignee: General Motors Corporation, Detroit, Mich.

[21] Appl. No.: 60,915

[22] Filed: Jun. 12, 1987

[51] Int. Cl.[4] ..... F02M 33/02

[52] U.S. Cl. ..... 123/520; 123/518; 123/519

[58] Field of Search ..... 123/520, 519, 518, 521, 123/516, 447, 463

[56] References Cited

U.S. PATENT DOCUMENTS

| | | | |
|---|---|---|---|
| 3,884,204 | 5/1975 | Frautwurst | 123/519 |
| 3,913,545 | 10/1975 | Haase | 123/520 |
| 4,040,404 | 8/1977 | Tagawa | 123/519 |
| 4,245,592 | 1/1981 | Atkins | 123/520 |
| 4,308,841 | 1/1982 | Kingsley | 123/520 |
| 4,527,532 | 7/1985 | Kasai | 123/520 |

FOREIGN PATENT DOCUMENTS

| | | | |
|---|---|---|---|
| 0027721 | 3/1978 | Japan | 123/520 |
| 0077545 | 6/1981 | Japan | 123/519 |

OTHER PUBLICATIONS

*Primary Examiner*—Carl Stuart Miller
*Attorney, Agent, or Firm*—Patrick M. Griffin

[57] ABSTRACT

A vapor recovery system has its purge valve opened with a time delay, following throttle opening, that allows the engine to get up to speed before vapor purging begins. However, the time delay varies, depending on how long the throttle has been closed. Therefore, if the throttle has been closed only a short time, and the engine has thus not decelerated enough that it will need as much time to get back up to speed, the delay in purging will be less.

2 Claims, 7 Drawing Sheets

VAPOR RECOVERY SYSTEM WITH VARIABLE DELAY PURGE

This application relates to vehicle fuel vapor recovery systems in general, and specifically to such a system in which the opening of a canister purge valve is delayed after an engine throttle is opened with a time delay that varies depending on how long the engine throttle was closed before opening.

BACKGROUND OF THE INVENTION

A typical vehicle fuel vapor recovery system found in a vehicle with a carbureted engine includes a vapor storage canister in which vapors from the fuel tank, and often from the carburetor float bowl as well, are adsorbed and stored, rather than being released to the atmosphere. These vapors are later purged from the canister by engine manifold vacuum and fed into a port in the throttle body located downstream of the throttle and burned in the engine. The withdrawal and burning of stored fuel vapors is generally controlled so as to in turn limit and control the richness of the fuel air mixture. For example, it would overly enrich the mixture if vapors were to be purged during engine idling. Therefore, it is desirable that purging begin only when, or at least be greatest when, the vehicle has reached a sufficient speed. Accordingly, the control system shown in U.S. Pat. No. 4,527,532 uses a speed sensor and a solenoid valve to increase the purging rate when that sufficient speed has been reached. While such an approach is obvious and is directly tailored to vehicle speed, it is expensive and somewhat complex, due to the electronics involved.

The more common approach is to control air fuel ratio with a strictly mechanical purge valve that is closed during engine idling, but which opens when the throttle opens, even though it takes some time after throttle opening for the vehicle to get up to speed. A typical example of a fuel vapor recovery system with such a control is illustrated in FIG. 7. A fuel tank 10 continuously feeds excess vapors to a storage canister 12. A throttle body 14 supports a carburetor bowl 16, and houses a throttle 18, with a manifold vacuum port 20 located downstream from throttle 18 and with a control vacuum port 22 located upstream from throttle 18. When throttle 18 is closed, as shown, the control vacuum port 22 is exposed to atmospheric pressure, but is exposed to manifold vacuum when throttle 18 is opened. A canister control valve, designated generally at 24, contains a purge valve, and also controls the vapor venting from carburetor bowl 16. Canister control valve 24 has a generally hollow body, and is ported to four lines, a canister line 26 that runs to canister 12, a carburetor bowl line 28 that runs to carburetor bowl 16, a manifold vacuum line 30 that runs to manifold vacuum port 20, and a control vacuum line 32 that runs to control vacuum port 22. Two internal spring and diaphragm valves, a vapor vent valve 34 and a purge valve 36, operate as follows. When the engine is off, there is no vacuum through line 30 or line 32, and both valves 34 and 36 are in the down position shown, meaning that vapor vent valve 34 is open, while purge valve 36 is closed. This allows fuel vapors to vent from carburetor bowl 16, through line 28 to line 26 and ultimately to canister 12, but blocks vapors from flowing from canister 12, through line 26 to line 30. When the engine has been started, but is only idling, throttle 18 will still be in the closed position shown, but there will be enough manifold vacuum through line 30 to close valve 34, and block vapors from venting from bowl 16. However, line 32 will still not be exposed to manifold vacuum, so purge valve 36 will remain closed, and there will be no vapor purging from canister 12. When throttle 18 opens, control vacuum port 22 becomes exposed to manifold vacuum, pulling up and opening purge valve 36. This allows vapors to purge from canister 12, through lines 26 and 30 and into throttle body 14 to be burned. As soon as throttle 18 recloses, port 22 becomes exposed to atmospheric pressure again, and purge valve 36 closes almost immediately, stopping the purging from canister 12. An optional thermal switch 38 in control vacuum line 32 prevents purging at all when the engine is cold.

The rapid closing of purge valve 36 upon the closing of throttle 18 is needed in order to prevent the fuel air mixture from becoming too rich during deceleration. However, the other side of the coin, the rapid opening of purge valve 36 upon the reopening of throttle 18, can cause a temporary over richness of the mixture. This is because, as noted, it takes some time after throttle opening for the vehicle and engine to get up to speed, and for the carburetor to develop sufficient airflow to be able to easily handle the increased fuel vapors from the canister. A partial solution is to put a one way air flow delay valve into the control vacuum line 32, between switch 38 and purge valve 36. Then, there will be a time delay between the opening of throttle 18 and the opening of purge valve 36, which will give the engine time to speed up before vapor purging begins. A shortcoming of this approach, however, is that in order to get sufficient delay, a fairly restrictive delay valve must be used. The purge valve 36 closes almost immediately when the throttle 18 closes, but that closing may be very short, with the vehicle and engine staying at substantially at the same speed, and thus more than capable of burning purged fuel vapors upon the reopening of throttle 18. However, the same, relatively long time delay in the reopening of purge valve 36 will occur as when it was initially opened, as the system has no way of distinguishing between the initial throttle opening and the reopening after only a short throttle closing. Delaying the reopening of purge valve 36 under these conditions, that is, when the engine is still more than capable of burning purged vapors, would undesirably reduce the degree of purging.

SUMMARY OF THE INVENTION

The invention solves the above noted shortcoming with a control means for the purge valve that provides a time delay that varies, depending on the amount of time that the throttle has been closed. The mechanism that provides the variable time delay is entirely mechanical and, therefore, relatively inexpensive.

The preferred embodiment of the invention disclosed is combined with a conventional vapor recovery system that has the type of canister control valve described above. A first delay valve is located in the control vacuum line, between the canister purge valve and the control vacuum port in the throttle body. The first delay valve faces so as to restrict the flow of air from the canister purge valve to the control vacuum port, but does not restrict air flow in the other direction. Between the first delay valve and the canister purge valve, a side line branches from the control vacuum line, and runs to an air accumulator. A second delay valve, similar to the first but facing in the opposite direction, is located in the side line, between the control vacuum line and the air accumulator. The second delay valve acts to restrict the flow of air from the control vacuum line to the accumulator, but does not restrict the flow of air from the accumulator to the control vacuum line.

In operation, when the throttle initially opens, after having been closed for a relatively long time, the control vacuum line will first draw air from the accumulator. The air so drawn from the accumulator flows freely through the side line and second delay valve and restrictively through the control vacuum line and first delay valve. The opening of the canister purge valve is thereby delayed for a period of time, until sufficient air has been drawn from the accumulator to in turn allow sufficient vacuum to be applied to the purge valve to open it. The delay gives the vehicle and engine time to get up to sufficient speed to efficiently burn the purged fuel vapors. Although the second delay valve does not contribute to the initial delay in the opening of the purge valve, the combined action of the accumulator and the first delay valve gives a substantially longer delay than could be achieved with the first delay valve alone. When the throttle is allowed to close, exposing the control vacuum port to atmospheric pressure, air will flow back freely through the control vacuum line and the first delay valve to the purge valve, thereby closing the purge valve almost immediately. Simultaneously, air will flow from the control vacuum line and restrictively through the side line and the second delay valve back to the accumulator. The restrictiveness of the second delay valve can be chosen to substantially delay the refilling of the accumulator since, as mentioned, it has no effect on the delay in the initial opening of the purge valve. Thus, if the throttle is closed only shortly, then the accumulator will refill only a small amount, and the amount that it does refill will depend on how long the throttle remains closed. Consequently, the delay in reopening the purge valve that occurs when the throttle is reopened will be significantly shorter than the initial delay involved at cold start, and the length of that delay will vary depending on how long the throttle has been closed.

It is, therefore, an object of the invention to provide a purge valve control means for a vehicle fuel vapor recovery system that delays the opening of the purge valve after the throttle has been opened by an amount that varies, depending on how long the throttle has been closed before being opened, so as to better control the richness of the air fuel mixture, but without decreasing the degree of stored fuel vapor purging.

It is another object of the invention to provide such a control means that is strictly mechanical, and which can be easily combined with an existing fuel vapor recovery system.

It is yet another object of the invention to provide such a control means that combines two oppositely facing one way air flow delay valves and a closed air accumulator which cooperate so as to delay the initial opening of the purge valve until the accumulator has been sufficiently emptied, giving a delay time sufficient for the engine to reach a desired speed, but which allows the purge valve to reclose almost immediately upon throttle closing, while delaying the reopening of the purge valve not by the same amount, but with a delay that varies depending on how long the accumulator has had to refill.

DESCRIPTION OF THE PREFERRED EMBODIMENT

These and other objects and features of the invention will appear from the following written description, and from the drawings, in which.

Figure 1:
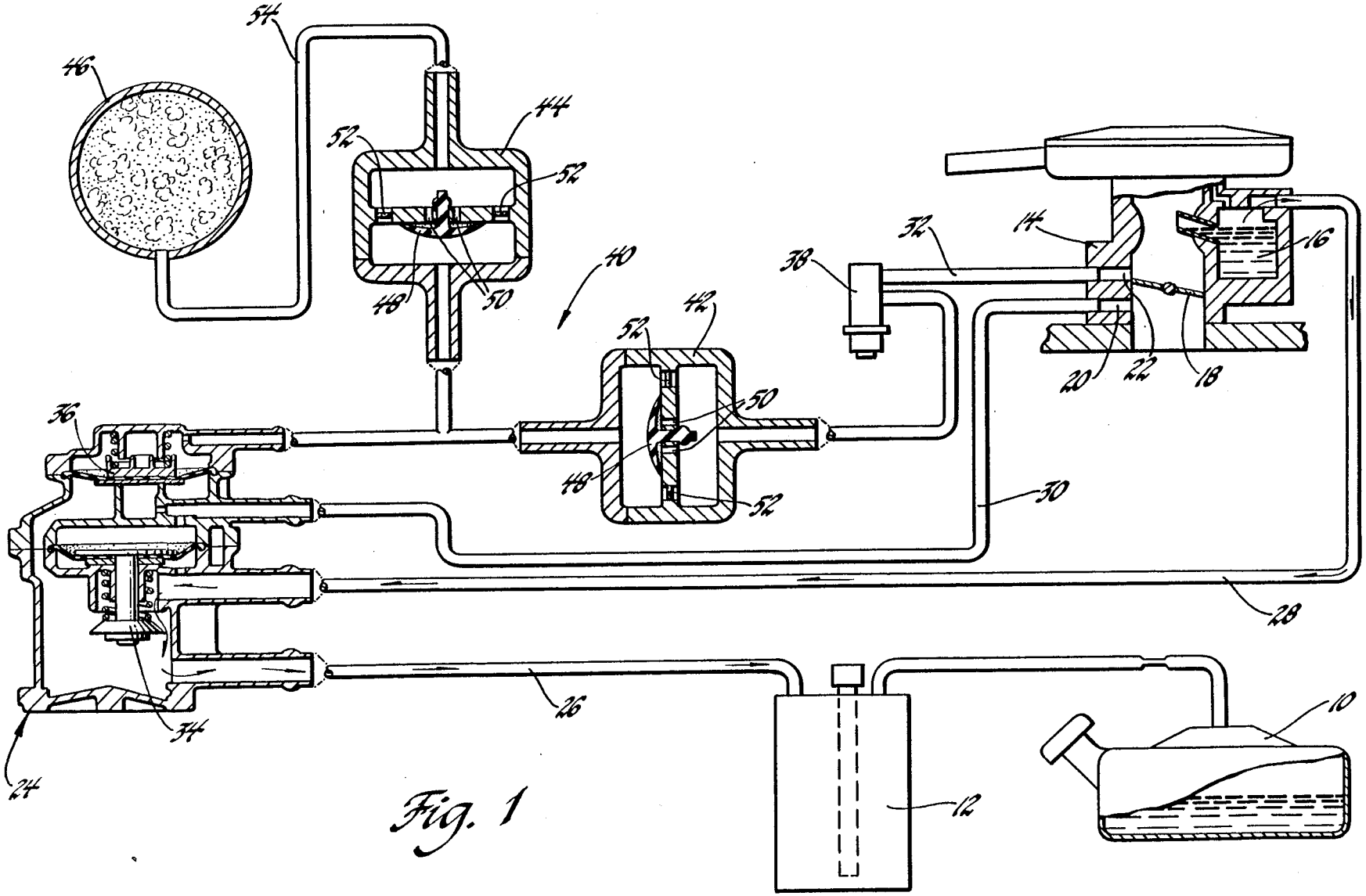
FIG. 1 is a view of the system before engine starting.

Referring first to FIG. 1, the conventional fuel vapor recovery system described above by reference to FIG. 7 is shown in combination with the variable delay control means of the invention, designated generally at 40. The variable delay control means of the invention 40 includes three basic components in combination, a first one way air flow delay valve, designated generally at 42, a second delay valve 44, and an air accumulator 46. Delay valve 42 is located in the control vacuum line 32, between the control vacuum port 22 and the purge valve 36, specifically between switch 38 and purge valve 36. Delay valve 42 is a commercially available sintered metal type, with a central internal umbrella 48 that covers non-restrictive flow passages 50, and which is surrounded by restrictive flow passages 52. Given the direction that first delay valve 42 faces, it will be understood that it acts to restrict the flow of air from the canister purge valve 36 toward the control vacuum port 22, but does not restrict air flow in the other direction. Second delay valve 44 is located in a side line 54, which branches from control vacuum line 32 between first delay valve 42 and purge valve 36, and which runs to the accumulator 46. Delay valve 44 is similar to first delay valve 42, with the same umbrella 48 and passages 50 and 52, but faces oppositely. Therefore, it will be understood that the second delay valve 44 acts to restrict the flow of air from the control vacuum line 32 to the accumulator 46, but does not restrict the flow of air from the accumulator 46 to the control vacuum line 32. Delay valves like 42 and 44 have an inherent delay or "bleed down" time that can be specifically chosen. Here, first delay valve 42 has a delay time of approximately a second, while second delay valve 44 has a delay time that is significantly longer, in the range of ten to fifteen seconds. The accumulator 46 is also a commercially available type, which is an aluminum bulb, closed except for its opening into side line 54. Accumulator 46 is at its fullest in FIG. 1, as indicated by the density of the stippling. The valves 42 and 44 and the accumulator 46 do not operate independently, but cooperate in a fashion that will be next described.

The operation of the control means 40 will be illustrated by following the operation of the entire system from the starting of the engine, through idling, accelerating, momentary closing of the throttle 18 and, finally, reopening of the momentarily closed throttle 18.

Figure 2:
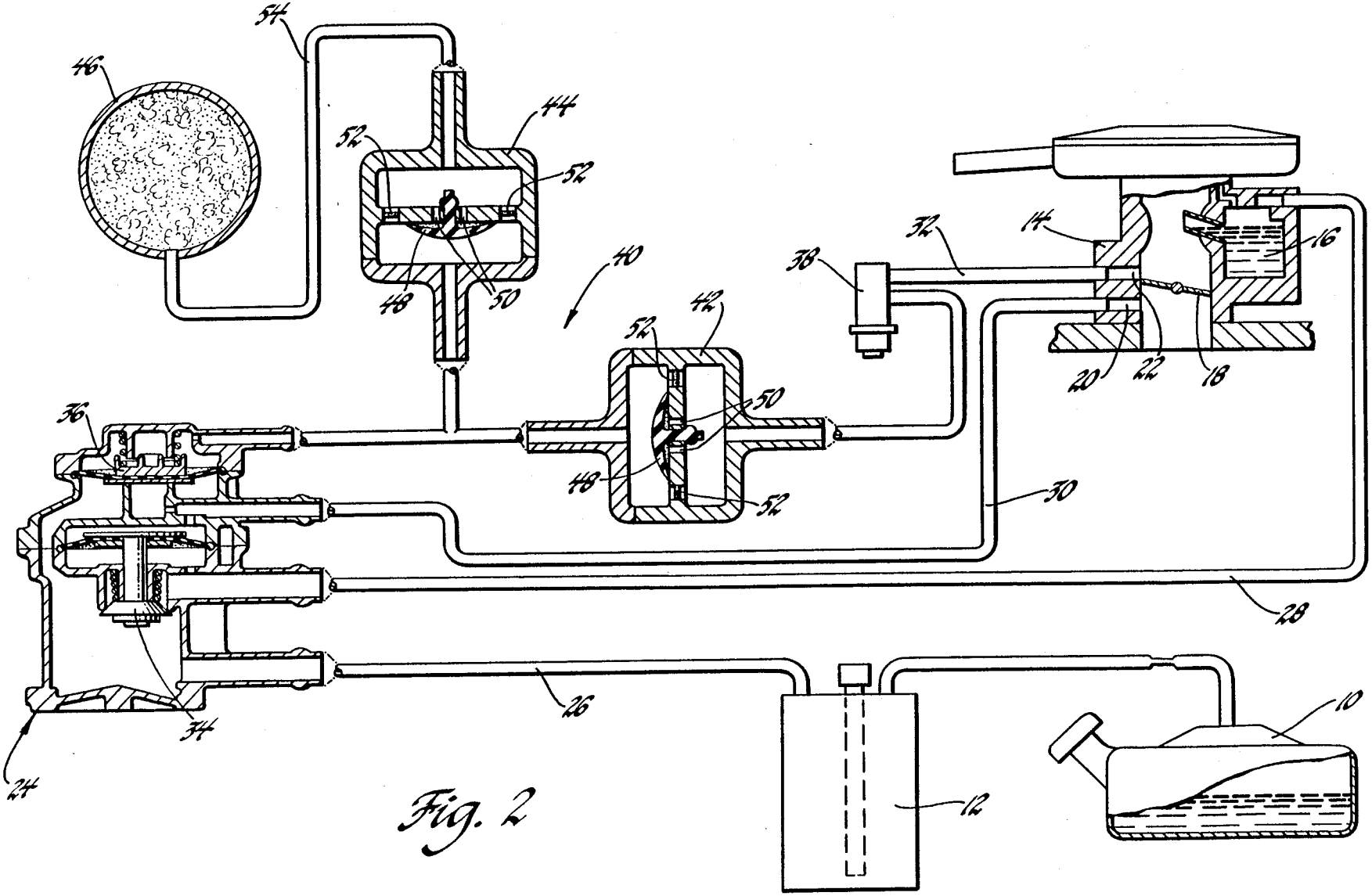
FIG. 2 is a view of the system after engine starting, during idling, and before the throttle has been opened.

Referring first to FIG. 2, after the engine has been cold started, vacuum from port 20, acting through manifold vacuum line 30, closes vapor vent valve 34, stopping the venting of carburetor bowl 16 through carburetor bowl line 30 to canister 12. Vent valve 34 remains closed so long as there is manifold vacuum through line 30, that is, until the engine stops. Because throttle 18 is still closed, no manifold vacuum has yet been applied to control vacuum port 22, which remains exposed to atmosphere. Consequently, purge valve 36 remains down, which is its closed position, and there is no vapor purging yet from canister 12. The accumulator 46 is still at its fullest, as in FIG. 1.

Figure 3:
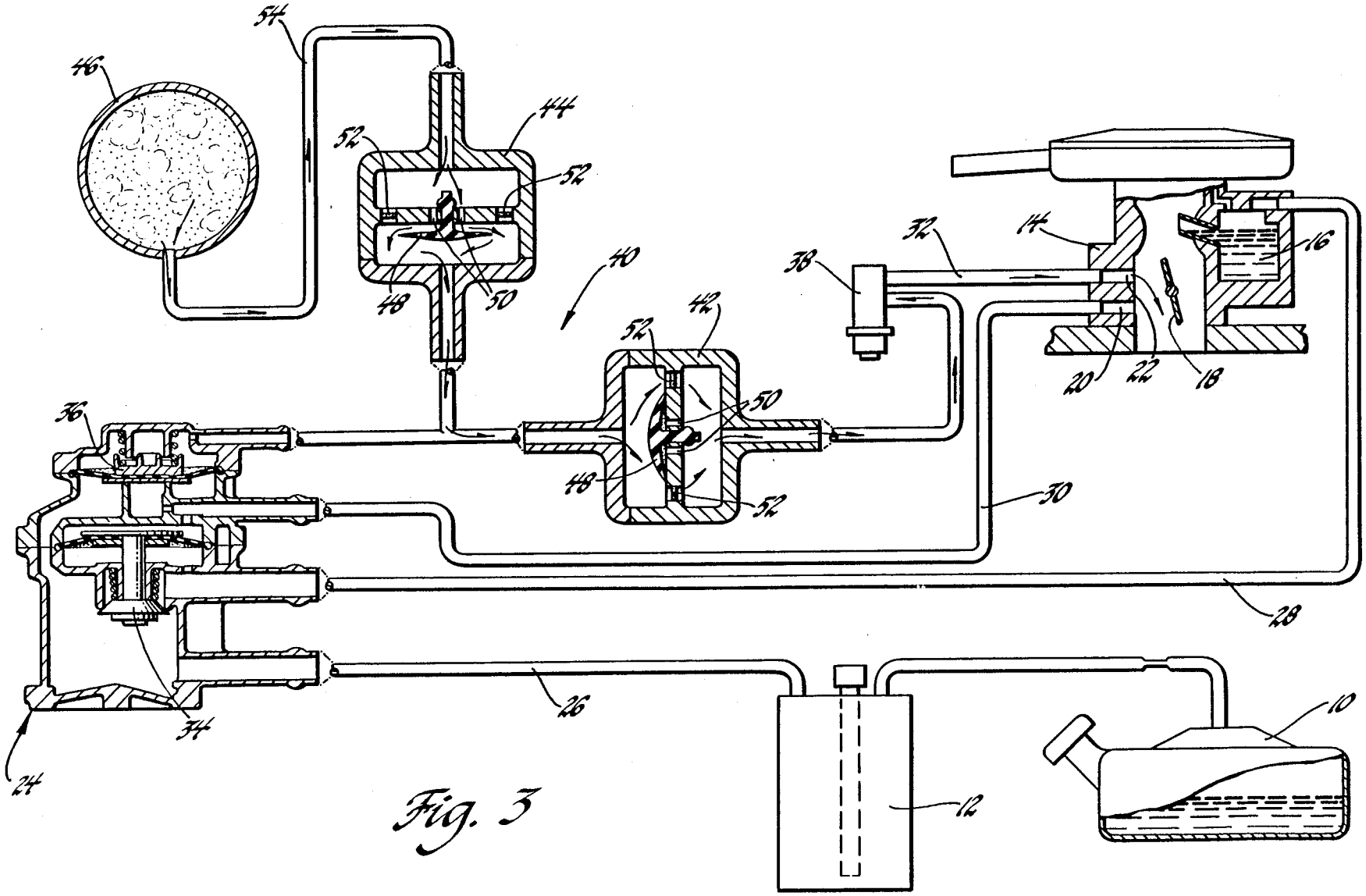
FIG. 3 is a view of the system after the throttle has been first opened, while the vehicle is accelerating, with the purge valve closed and the accumulator emptying.

Referring next to FIG. 3, when the throttle 18 is initially opened from idle, the control vacuum port 22 is exposed to manifold vacuum, and, assuming that the engine is warm enough for switch 38 to be open, air is drawn through control vacuum line 32 and slowly through first delay valve 42 to port 22. The air so drawn through control vacuum line 32 must first be drawn down from accumulator 46 before sufficient vacuum is presented to purge valve 36 to pull it up and open it. The flow of air from accumulator 46, shown by arrows, proceeds freely through second delay valve 44 and through side line 54 to control vacuum line 32. Accumulator 46 is shown about half filled, as indicated by the less dense stippling. The volume of accumulator 46, and the inherent delay characteristics of first delay valve 42, will determine the amount of time delay before purge valve 36 can be opened. In the embodiment disclosed here, the first delay valve 42 and accumulator 46 cooperate to give a predetermined time delay in the range of five to ten seconds, while the first valve 42 acting alone would give a much shorter delay of about a second. That predetermined time delay, in turn, would be tailored to the particular acceleration characteristics of the engine involved so as to assure that the vehicle and engine will generally have reached a speed sufficient to handle purged fuel vapors with optimum efficiency, before purge valve 36 opens.

Figure 4:
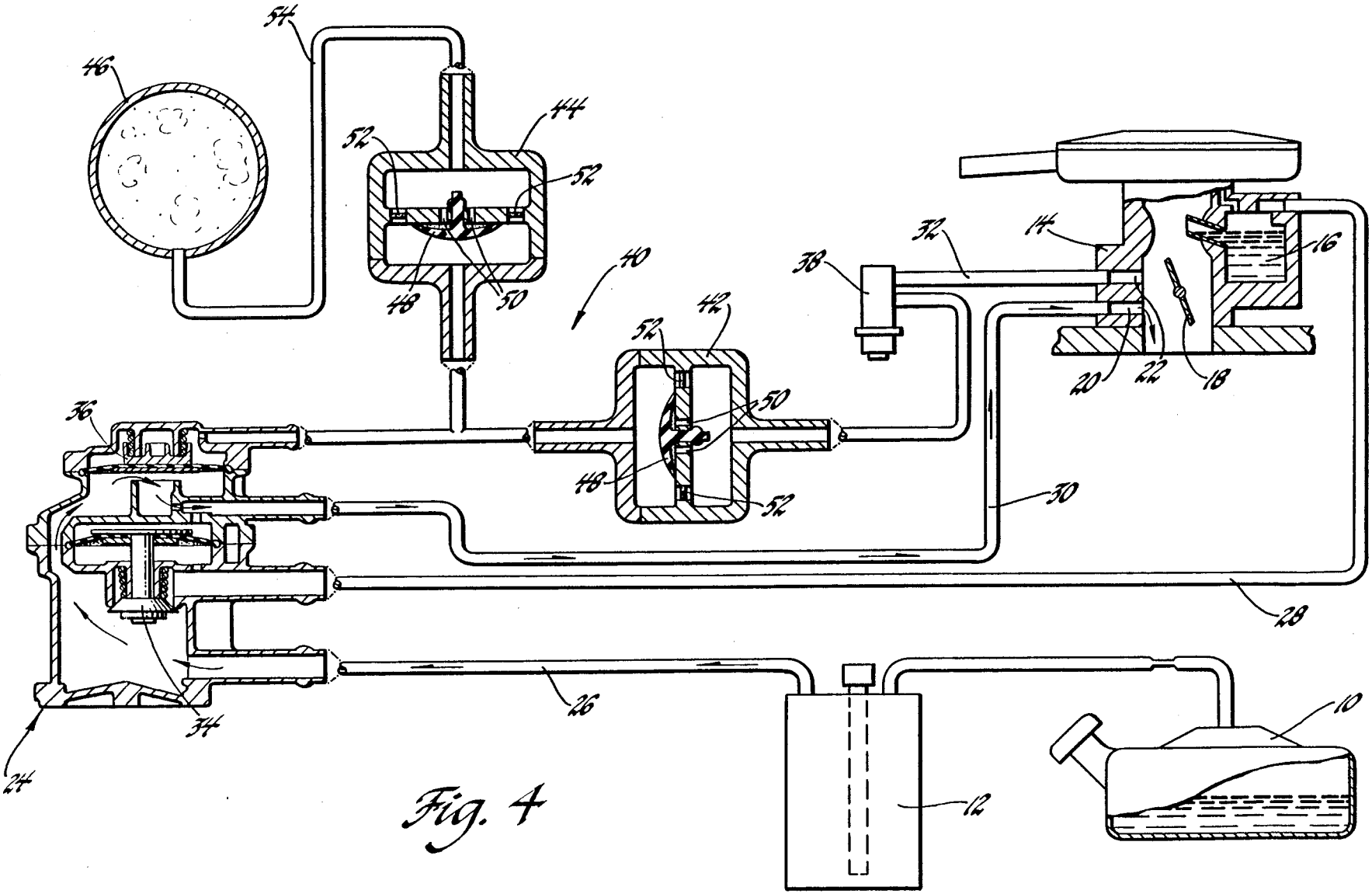
FIG. 4 is a view of the system after the throttle has been open long enough for the accumulator to empty sufficiently for the purge valve to open.

Next, FIG. 4 shows the system after the engine has accelerated long enough to have reached the desired speed, with the accumulator 46 having substantially emptied. Enough manifold vacuum will then be applied to purge valve 36, through control vacuum line 32, to pull it up and open. Then, adsorbed fuel vapors are purged from canister 12, through canister line 26, through the body of canister control valve 24, and then through manifold vacuum line 30 to manifold vacuum port 20 to be burned. Enough air is then flowing through throttle body 14 that the air fuel mixture will not become overly enriched. While purging valve 36 is open, which will continue so long as throttle 18 is not allowed to close, there is no air flow through line 32.

Figure 5:
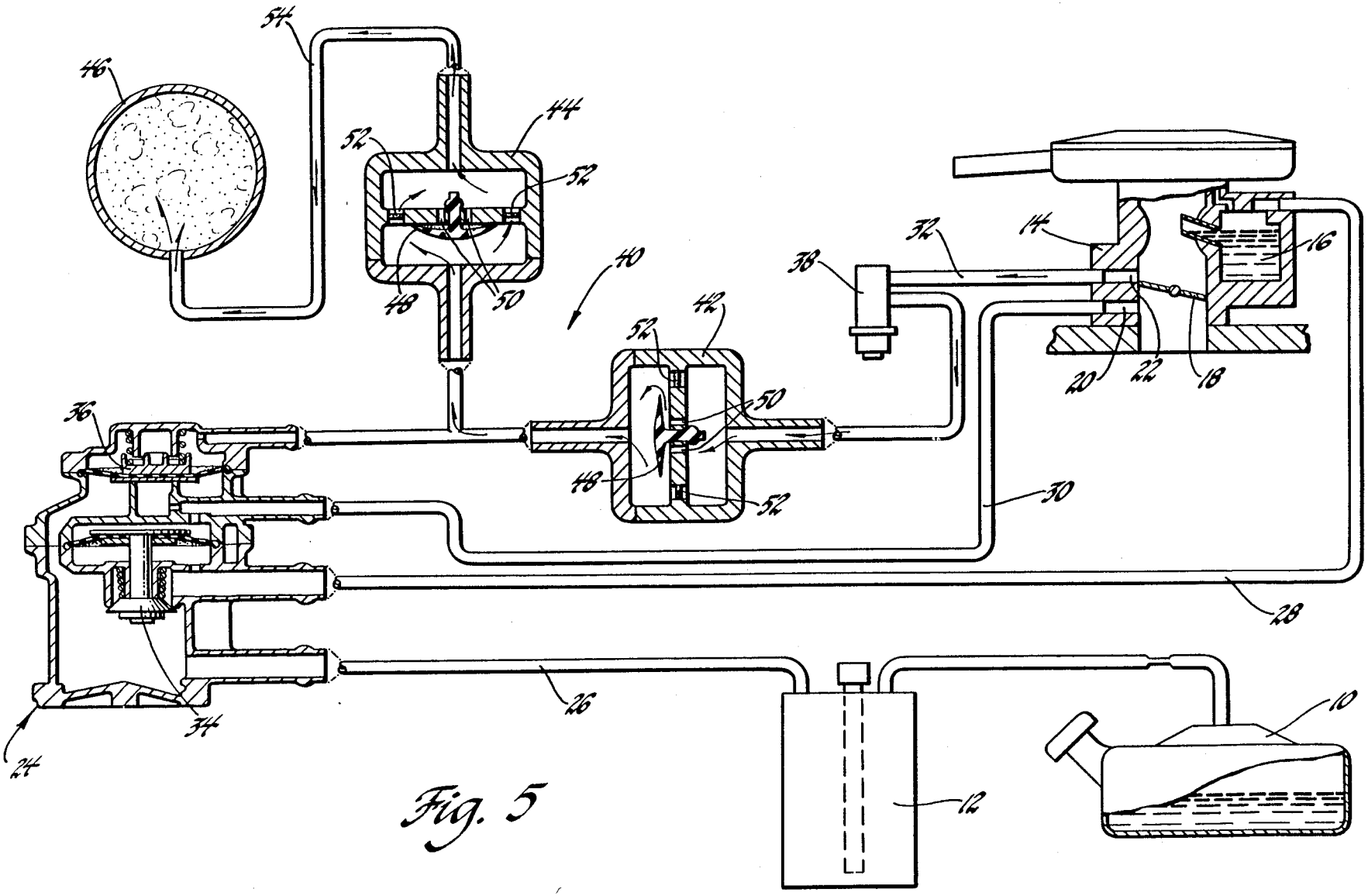
FIG. 5 is a view of the system after the throttle has closed and the purge valve has reclosed, and the accumulator has had time to partially refill.

Next, FIG. 5, shows the system after throttle 18 has been allowed to close momentarily. Vacuum control port 22 is then immediately re-exposed to atmosphere, and air consequently flows immediately back through control vacuum line 32, in the non-restricted direction through first delay valve 42. The vacuum at purge valve 36 is quickly relieved, which allows valve 36 to quickly close, stopping the purge of vapors from canister 12. Concurrently, air begins to flow up side line 54, slowly through second delay valve 44, and back into accumulator 46, as shown by the arrows. How much air will flow back into accumulator 46 will depend on how long the throttle 18 remains closed, and on the time delay character of second delay valve 44. Since second valve 44 is chosen to be more restrictive than first valve 42, as noted above, very little air will refill accumulator 46 during a short closing of the throttle. And, the shorter the time that throttle 18 is closed, the lesser the volume of air that will flow back in. Accumulator 46 is illustrated as being about one-third refilled in FIG. 5.

Figure 6:
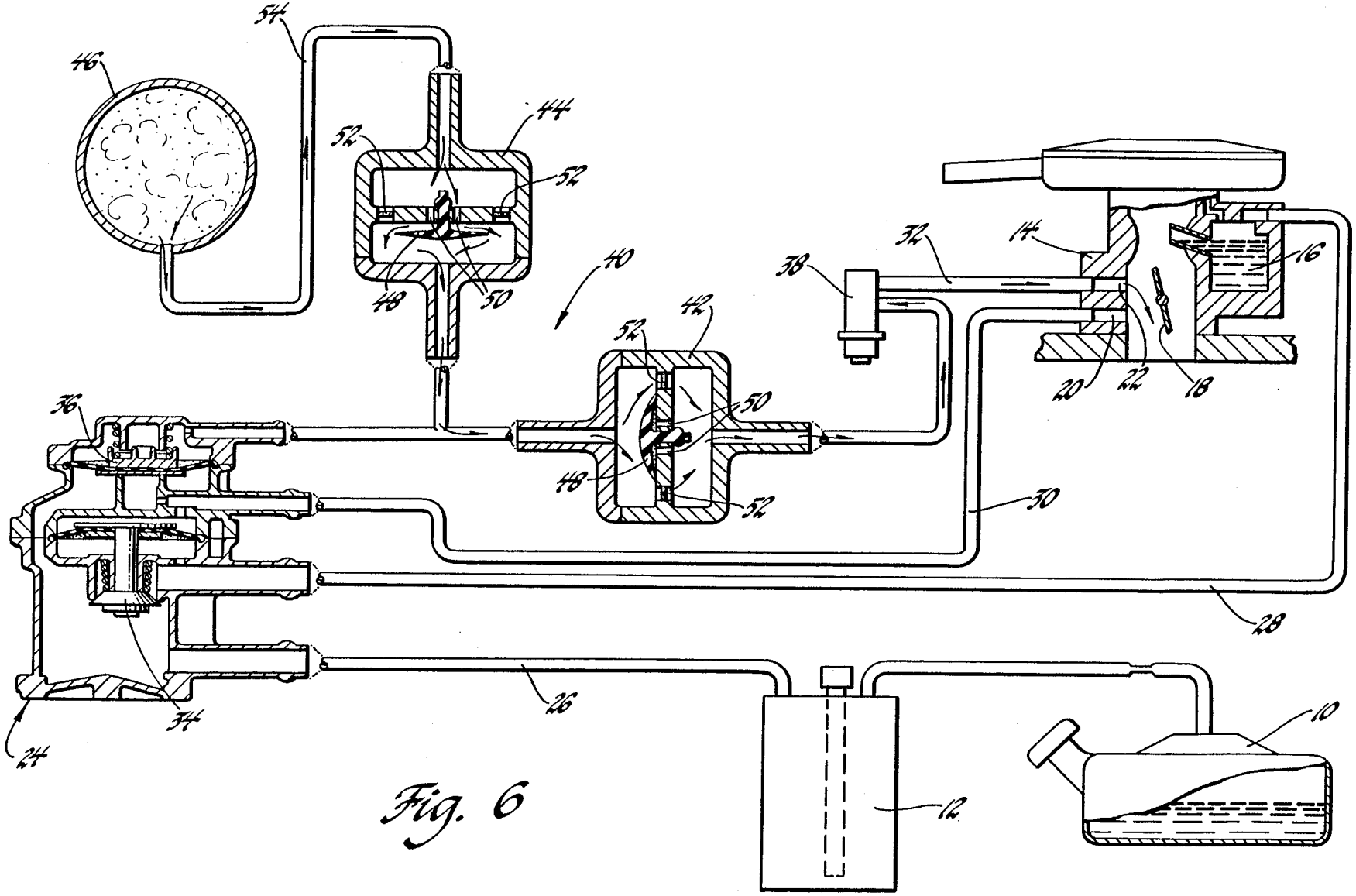
FIG. 6 is a view of the system when the throttle has been reopened after having been closed only long enough for the accumulator to partially refill, showing the purge valve still closed, and the partially refilled accumulator being emptied again.

Referring finally to FIG. 6, the situation is shown after throttle 18 has been quickly reopened, before the vehicle has had time to decelerate a great deal. The same sequence of events that began when throttle 18 was first opened from idle begins again, with air flowing out of accumulator 46, freely through valve 44 and slowly through valve 42, with the air flow in the same direction as was shown in FIG. 3. However, since the accumulator 46 started out less full than it was when the throttle 18 was first opened, (FIG. 2) the delay in reopening the purge valve 36 is proportionally less. If the throttle 18 is closed a very short time, then the delay in reopening of purge valve 36 is almost none, since very little air will have refilled accumulator 46. This is just what is desired, since the vehicle will need less time to re-accelerate to the same speed. This is to be contrasted with the case of a single delay valve 42, where the delay in reopening purge valve 36 would be invariant, undesirably delaying purge when the vehicle engine was more than capable of efficiently accepting purged fuel vapors almost immediately. Thus, the delay valves 42 and 44, and the accumulator 46, although they are, by themselves, relatively simple mechanical parts, cooperate in the configuration of the invention to give a combination of significant advantages.

Figure 7:
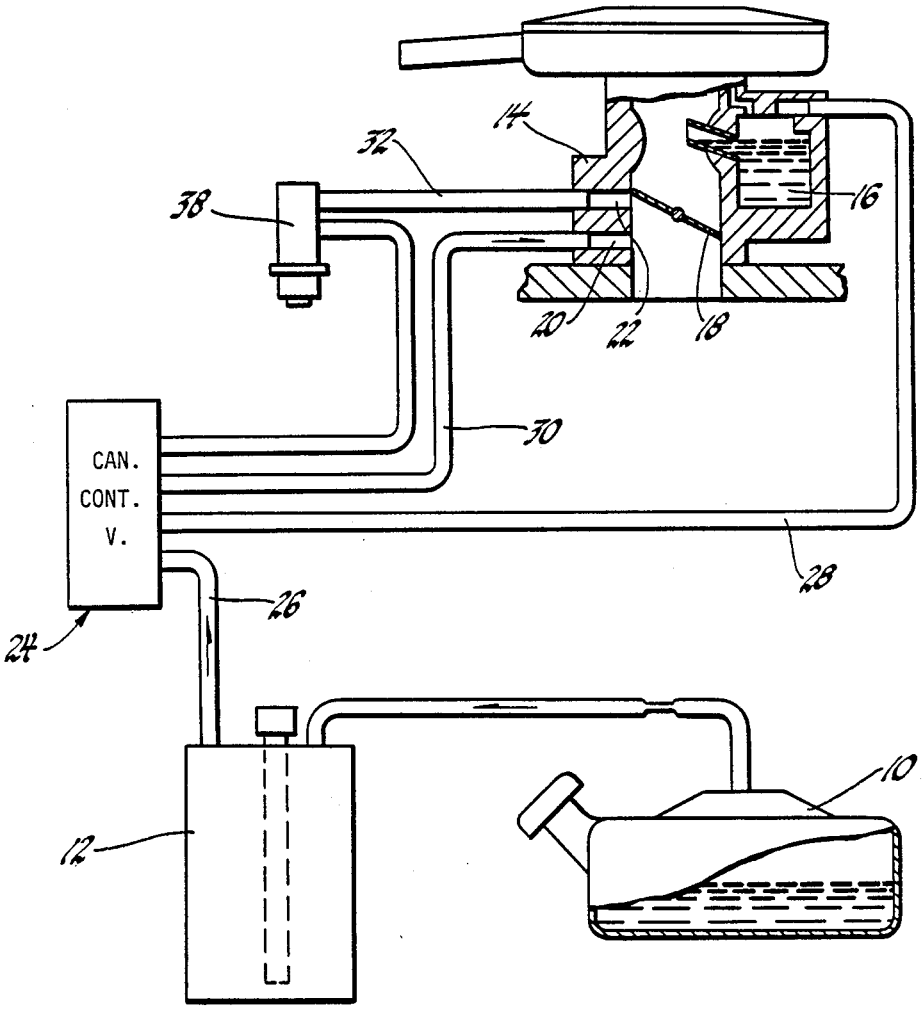
PRIOR ART Fig. 7
FIG. 7 shows a conventional prior art vapor recovery system.

The embodiment 40 of the invention disclosed is particularly advantageous, because it may be easily retrofitted to the conventional vapor recovery system illustrated in FIG. 7. However, it may be incorporated in any vapor recovery system with a purge valve that is activated by control vacuum. The invention could also be incorporated in control systems that do not have an on-off purge valve as such, but which have a purge valve that provides a continuously variable rate of purging. Such a variable rate valve could still be activated with the variable time delay of the invention, just as the purge valve 36 here is turned completely on and off. An air valve means other than the two delay valves 42 and 44 disclosed could be substituted, so long as, when throttle 18 was first opened, it provided for freely draining the accumulator 46, but restricting the flow of air through control vacuum line 32, and so long as it also provided for refilling accumulator 46 restrictively when the throttle 18 was closed, but still allowed for the free flow of atmospheric air back through line 32 to quickly close purge valve 36. Different combinations of inherent delay characteristics of valves 42 and 44 and volumes of accumulator 46 can be chosen to give any combination of initial purge valve opening delay and purge valve reopening delay desired, depending on the particular engine involved. Therefore, it will be understood that the invention could be embodied in structures other than the preferred embodiment disclosed here, and is not intended to be so limited.

The embodiments of the invention in which an exclusive property or privilege is claimed are defined as follows:

1. In a vehicle fuel vapor recovery system of the type in which fuel vapors are selectively drawn from a vapor storage canister through a canister purge valve and purge line by engine manifold vacuum to be burned in the engine, said canister purge valve being activated by vacuum drawn through a control vacuum line from a control vacuum source that is exposed either to manifold vacuum or to atmosphere respectively as an engine throttle is opened or closed, a control means for activating said canister purge valve with a time delay after throttle opening that depends on how long said throttle has been closed before opening, said control means comprising, in combination, an air accumulator in communication with said control vacuum line to which air can be sent and from which air can be drawn, and air valve means acting in cooperation with said accumulator to restrict the drawing of air through said control vacuum line when said throttle is first opened, but allowing unrestricted drawing of air from said accumulator, said air valve means also acting, when said throttle is closed, to restrict the refilling of said accumulator, but allowing unrestricted flow of atmospheric air back through said control vacuum line to said canister purge valve, whereby, when said throttle initially opens and said control vacuum source first applies vacuum to said control line, air will first be drawn freely from said accumulator, but restrictively through said control vacuum line, thereby delaying the activating of said canister purge valve until sufficient air has been drawn from said accumulator to allow sufficient vacuum to be applied to said purge valve to activate it, after which, when said throttle is closed, air will flow back from atmosphere freely through said control line to said purge valve, thereby deactivating said purge valve substantially immediately, while air simultaneously flows back restrictively to said accumulator, so that the amount of air that flows back to said accumulator will be proportional to the amount of time that said throttle remains closed, and the delay in reactivating said purge valve when said throttle is reopened will accordingly be shorter than the initial delay if said throttle does not remain closed long enough for said accumulator to completely refill.

2. In a vehicle fuel vapor recovery system of the type in which fuel vapors are selectively drawn from a vapor storage canister through a canister purge valve and a purge line by an engine manifold vacuum to be burned in the engine, said canister purge valve being opened and closed by vacuum drawn through a control vacuum line from a control vacuum source that is exposed either to manifold vacuum or to atmosphere respectively as an engine throttle is opened or closed, a control means for opening and closing said canister purge valve with a time delay after throttle opening that depends on how long said throttle has been closed before opening, said control means comprising, in combination, a first delay valve located in said control vacuum line between said canister purge valve and said control vacuum source, said first delay valve facing so as to restrict the flow of air from said canister purge valve to said control vacuum source, but not restrict the flow of air from said control vacuum source to said canister purge valve, a side line branching from said control line between said first delay valve and said canister purge valve and extending to, an air accumulator to which air can be sent and from which air can be drawn through said side line, and a second delay valve located in said side line between said control vacuum line and said air accumulator, said second delay valve facing so as to restrict the flow of air from said control vacuum line to said accumulator, but not restrict the flow of air from said accumulator to said control line, whereby, when said throttle initially opens and said control vacuum source first applies vacuum to said control line, air will first be drawn from said accumulator, freely through said side line and second delay valve and restrictively through said control vacuum line and first delay valve, thereby delaying the opening of said canister purge valve until sufficient air has been drawn from said accumulator to allow sufficient vacuum to be applied to said purge valve to open it, after which, when said throttle is closed, air will flow back from atmosphere freely through said control line and first delay valve to said purge valve, thereby closing said purge valve substantially immediately, while air simultaneously flows from said control vacuum line through said side line and restrictively through said second delay valve back to said accumulator, so that the amount of air that flows back to said accumulator will be proportional to the amount of time that said throttle remains closed, and the delay in reopening said purge valve when said throttle is reopened will accordingly be shorter than the initial delay if said throttle does not remain closed long enough for said accumulator to completely refill.

* * * * *